US007323650B2

(12) United States Patent
Yu

(10) Patent No.: US 7,323,650 B2
(45) Date of Patent: Jan. 29, 2008

(54) PROTECTION MECHANISM FOR SWITCH

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 11/465,804

(22) Filed: Aug. 19, 2006

(65) Prior Publication Data

US 2006/0279396 A1 Dec. 14, 2006

Related U.S. Application Data

(62) Division of application No. 10/872,937, filed on Jun. 19, 2004, now Pat. No. 7,202,769.

(51) Int. Cl.
*H01H 21/24* (2006.01)

(52) U.S. Cl. ..... 200/557; 200/339

(58) Field of Classification Search ..... 200/339, 200/401, 557–559, 553; 337/37, 59, 66, 337/67, 70, 72–75

See application file for complete search history.

(56) References Cited

U.S. PATENT DOCUMENTS 3,115,555 A * 12/1963 Lescarboura ..... 200/5 R
4,489,297 A * 12/1984 Haydon et al. ..... 335/207
5,933,069 A * 8/1999 Huang ..... 337/66
7,208,693 B1 * 4/2007 Yu ..... 200/553

* cited by examiner

*Primary Examiner*—Michael A Friedhofer
*Assistant Examiner*—Lisa Klaus

(57) ABSTRACT

A protection mechanism includes a first member connected to a switch member pivotably connected to an open top of a case so as to lift a bimetallic plate when the switch device is set to an "OFF" status, and a second member that is pivotably connected to an extension board extending form the switch member. The second member is located above the bimetallic plate and pushes the bimetallic plate downward to set the switch device to an "ON" status. The second member can be pivoted counter clockwise when the bimetallic plate is deformed upward and will not stop the deformation of the bimetallic plate.

6 Claims, 8 Drawing Sheets

(OFF)

(OFF)

(ON)

(OFF)

(ON)

PROTECTION MECHANISM FOR SWITCH

CROSS-REFERENCES TO RELATED APPLICATIONS

This is a division of U.S. application Ser. No. 10/872,937, filed Jun. 19, 2004; now U.S. Pat. No. 7,202,769, issued Apr. 10, 2007.

FIELD OF THE INVENTION

The present invention relates to a protection mechanism for protecting a switch device from being burned due to incomplete disconnection between a bimetallic plate and a terminal in an "ON" status.

BACKGROUND OF THE INVENTION

A conventional circuit breaker comprises a fuse arranged between a switch and a circuit such that when an electrical overloading occurs, the fuse melts before the overloading causes damages to the circuit. However, if the fuse is not properly installed or an improper fuse is used, the overloading current cannot melt the fuse, leading to a disaster. U.S. Pat. Nos. 5,262,748, 4,167,720, 4,937,548, 5,223,813, 5,451,729, and 5,558,211 disclose different types of circuit breakers that all include a complicated mechanism to drive a bimetallic plate which is expected to deform and bend when an overloading occurs. Nevertheless, it is noted that the bimetallic plate does not always deform as desired to trigger the protection mechanism because the plate may not be allowed to freely deform, and remains in contact with the terminal so that sparks are produced and therefore cause disaster.

Therefore, it is desired to have a protection mechanism for a switch device that provides a space sufficient to allow the bimetallic plate to properly deform when an overloading occurs in order to resolve the shortcomings of the conventional switch devices.

SUMMARY OF THE INVENTION

In accordance with an aspect of the present invention, there is provided a switch device comprising a case having an open top for entry of a switch member. First and second terminals respectively extend through a bottom of the case. A bimetallic plate has a first end fixed to the first terminal and a second end connected to a first contact point. A second contact point is connected to the second terminal and located beneath the first contact point. A protection mechanism includes a first member that has a hook portion for lifting the second end of the bimetallic plate. An upper end of the first member is pivotably connected to the switch member. A second member has a top end pivoted to the switch member and a lower end driven at angle by the second end of the bimetallic plate when an overloading occurs.

The present invention will become more obvious from the following description thereof when taken in connection with the accompanying drawings, which show, for purposes of illustration only, preferred embodiments in accordance with the present invention.

DETAILED DESCRIPTION OF THE PREFERRED EMBODIMENTS

Figure 1:
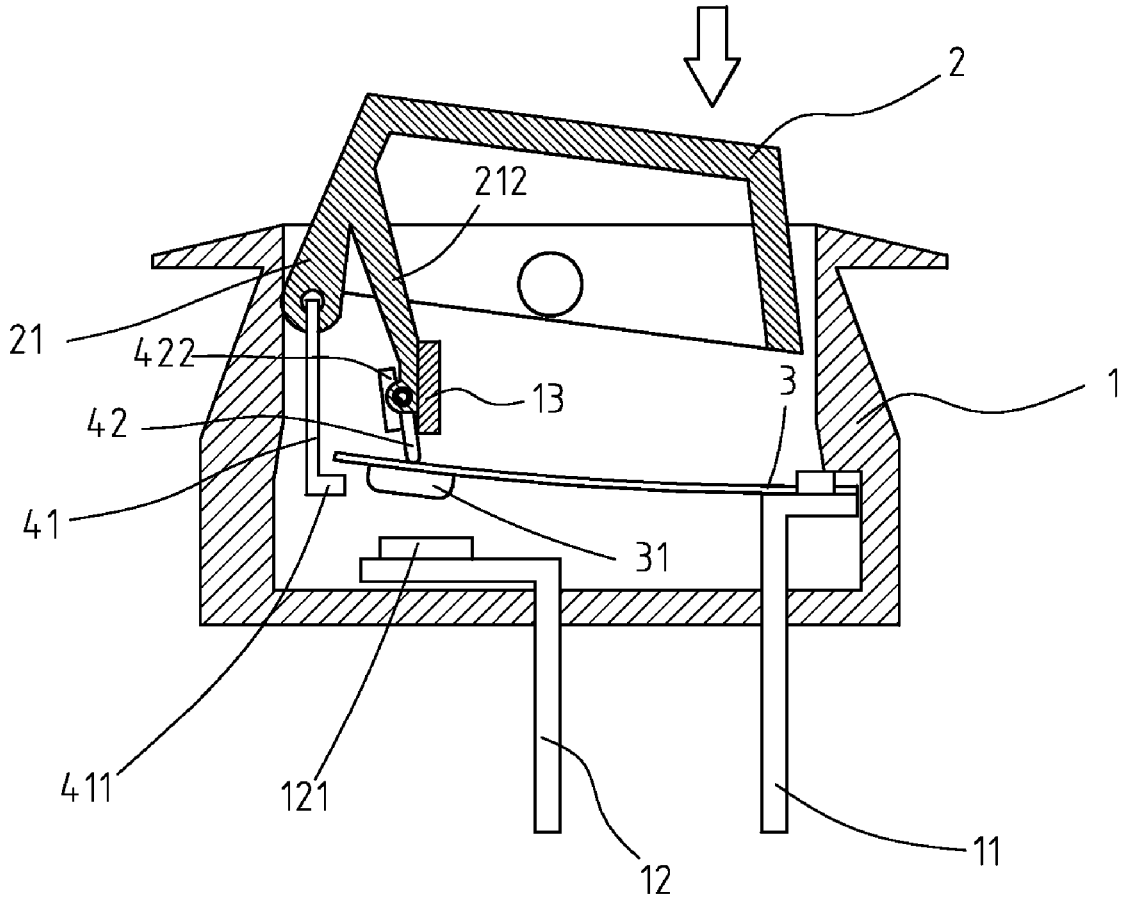
FIG. 1 shows an "OFF" status of a switch device constructed in accordance with the present invention.
Figure 2:
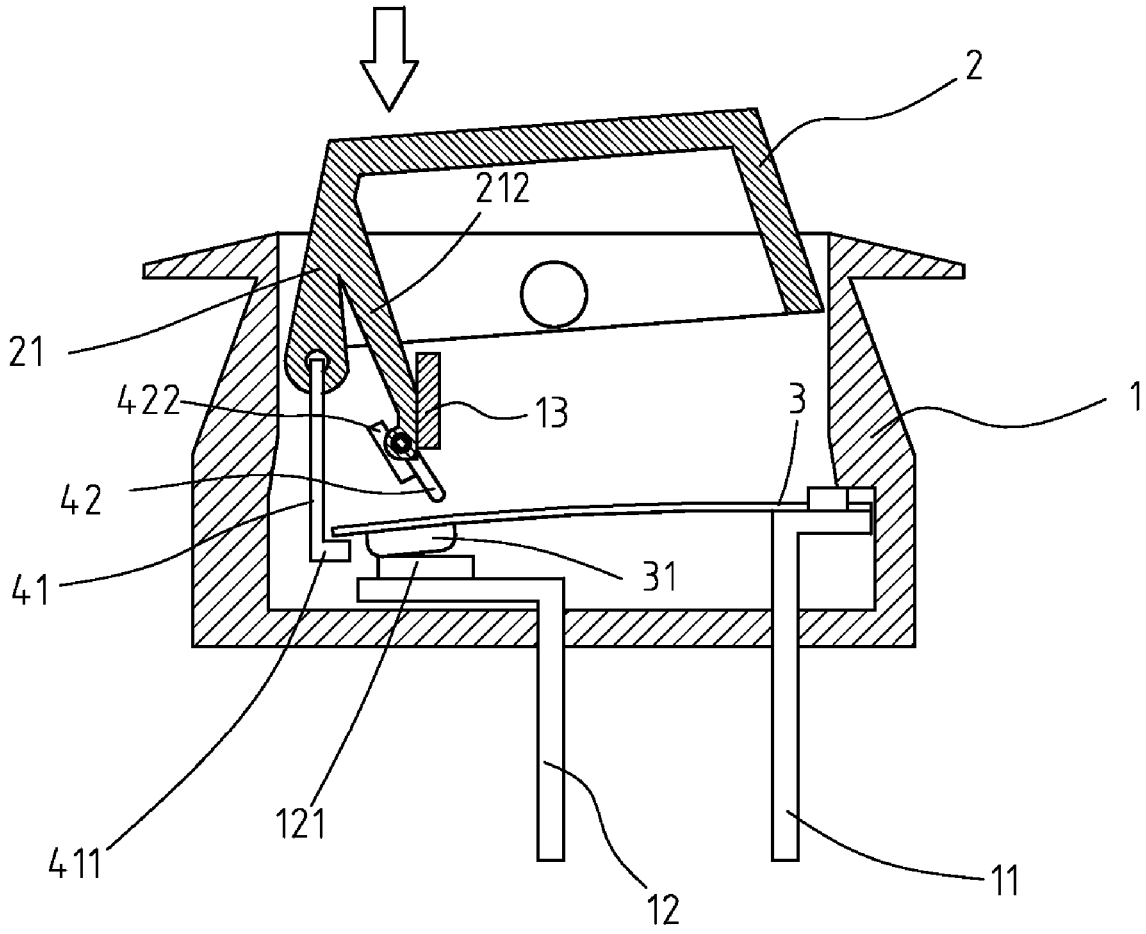
FIG. 2 shows an "ON" status of the switch device of the present invention.
Figure 4:
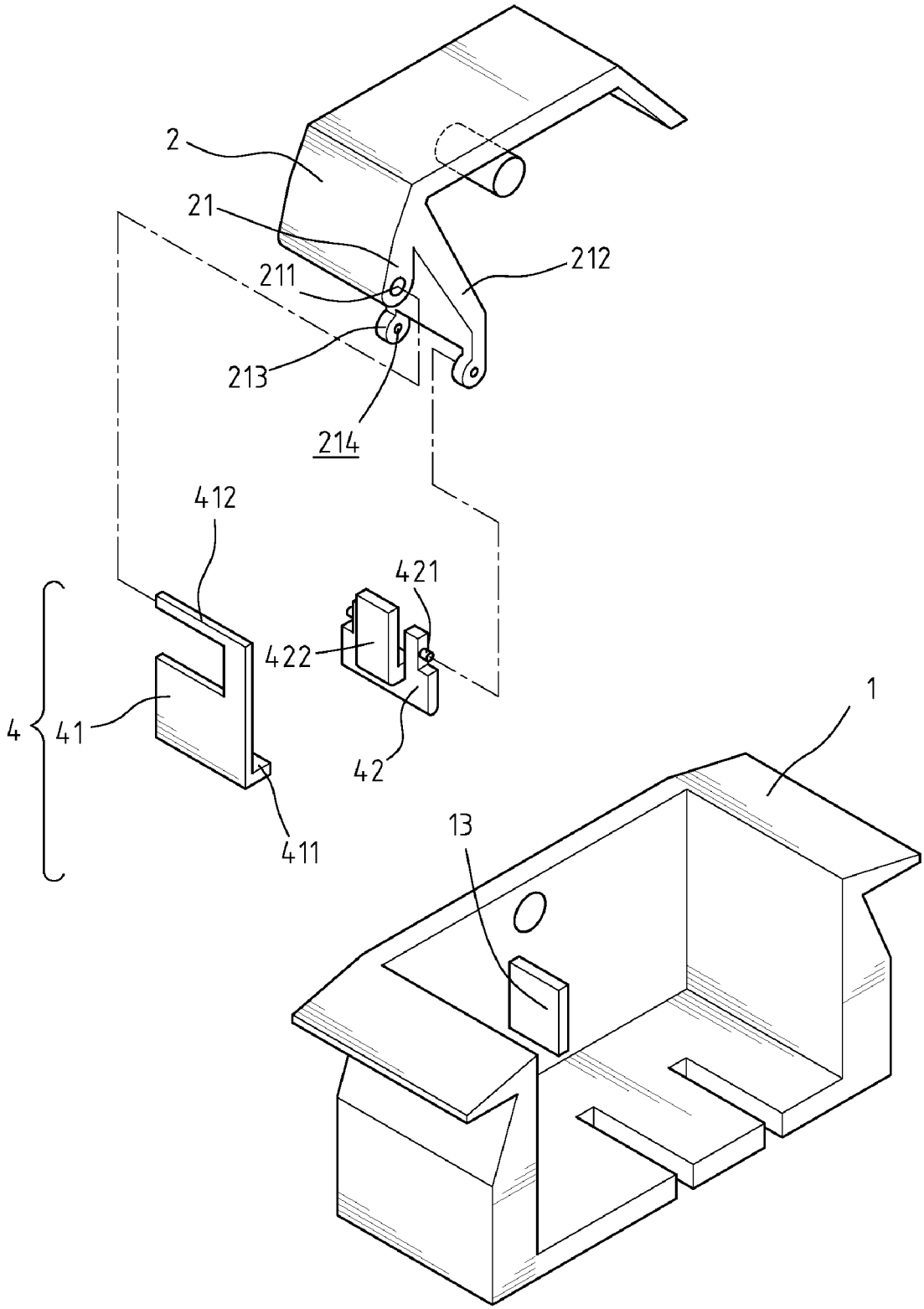
FIG. 4 is an exploded view showing a protection mechanism of the switch device of the present invention.

Referring to the drawings and in particular FIGS. 1, 2 and 4, a switch device constructed in accordance with the present invention comprises a case 1 having an open top and a switch member 2 pivotally engaging the open top of the case 1. A stop board 13 extends from an inside of the case 1. A first terminal 11 and a second terminal 12 respectively extend through a bottom of the case 1. A bimetallic plate 3 has a first end fixed to the first terminal 11 and a second end connected to a first contact point 31. A second contact point 121 is connected to the second terminal 12 and located beneath the first contact point 31. The switch member 2 has a connection portion 21 and an extension board 212 extending from a bottom thereof. The extension board 212 is slidably guided on the stop board 13. A passage 211 is defined through the connection portion 21. A connection port composed of two lugs 213 is connected to a lower end of the extension board 212.

The protection mechanism 4 includes a first member 41 and a second member 42. The first member 41 has a hook portion 411 at a lower end thereof and an insertion 412 extends from an upper end of the first member 41. The insertion 412 is pivotably inserted in the passage 211 in the connection position 21 of the switch member 2. A second end of the bimetallic plate 3 is located above the hook portion 411 so that when the switch member 2 is pressed as shown in FIG. 1 to set the switch device to "OFF" status, the second end of the bimetallic plate 3 can be lifted to separate the first and second contact points 31, 121 from each other. Each of the two lugs 213 of the connection port includes a hole 214. Two protrusions 421 extend from two opposite ends of the top of the second member 42 are respectively engaged with the two holes 214 in the two lugs 213. A weight 422 is connected on one of two opposite surfaces of the second member 42 so that the second member 42 tilts an angle when pivotably connected to the switch member 2. The second member 42 cannot pivot clockwise because of the stop board 13. When the switch member 2 is pressed to set the switch device to "ON" status, the second end of the bimetallic plate 3 is pushed by the extension board 212 and a lower end of the second member 42 as shown in FIG. 2.

Figure 3:
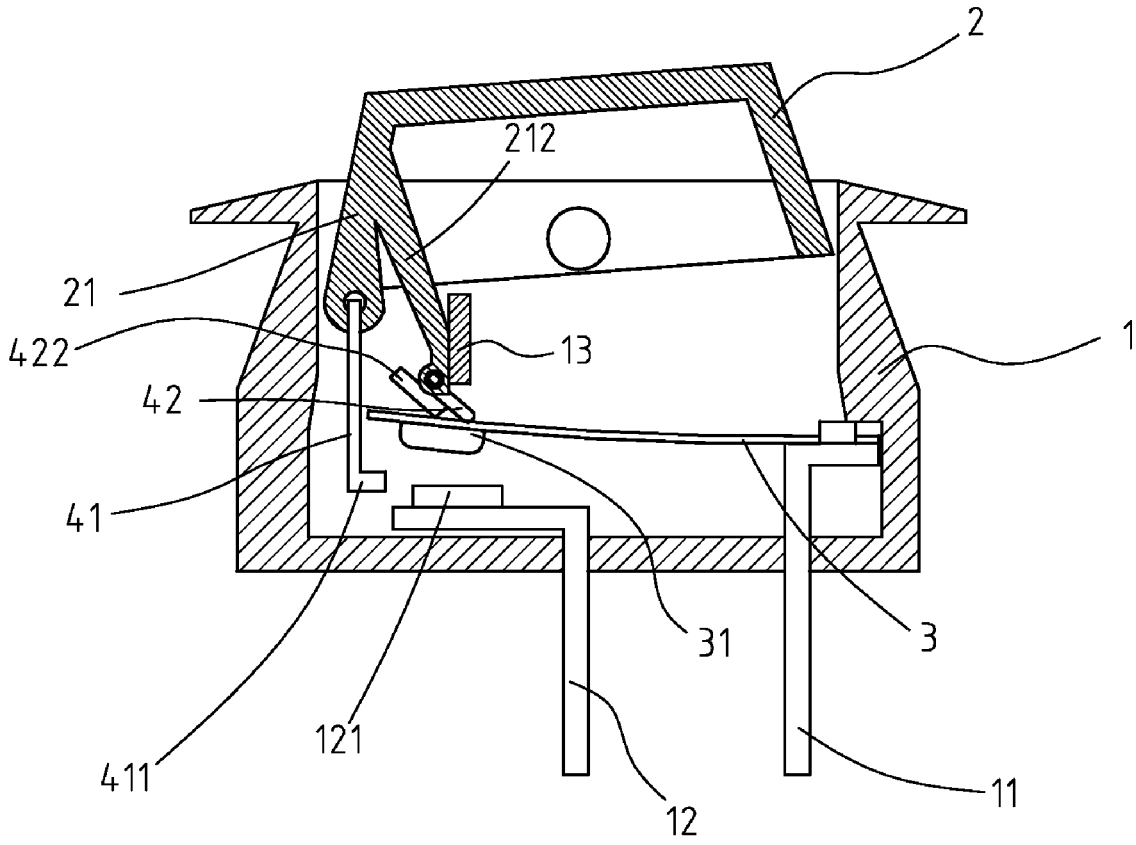
FIG. 3 shows a bimetallic plate of the switch device deformed upward and a second member pivoted by the bimetallic plate when an overloading occurs.

When the circuit is overloaded, as shown in FIG. 3, the second end of the bimetallic plate 3 is deformed upward and pivots the second member 42 counterclockwise. In other words, the second member 42 cannot stop the deformation movement of the second end of the bimetallic plate 3 so that the first and second contact points 31, 121 are definitely separated from each other to cut off the circuit.

FIGS. 5-8 show a switch device in accordance with another embodiment of the present invention. The switch device comprises a case 1 having an open top and a switch member 2 pivotally engages the open top of the case 1. A box 14 is connected to an inside of the case 1. A spring 15 is received in the box 14. The box 14 has a slot 141 defined in one of sidewalls thereof. A connection member 43 includes a horizontal portion extending horizontally therefrom and has a neck 432 movably received in the slot 141. A boss 431 extends from the horizontal portion so as to fit in a top of the spring 15 that biases the horizontal portion toward the switch member 2. The switch member 2 has an extension board 22 extending from a bottom thereof so as to press on the connection member 43. The connection member 43 has a connection port composed of two lugs 433 and each lug 433 has a hole 434 defined therethrough. A first terminal 11 and a second terminal 12 respectively extend through a bottom of the case 1. A bimetallic plate 3 has a first end fixed to the first terminal 11 and a first contact point 31 is connected to a second end of the bimetallic plate 3. A second contact point 121 is connected to the second terminal 12 and located beneath the first contact point 31.

The protection mechanism 4 includes a first member 41 that has a lower end forming a hook portion 411 and an upper end of the first member 41 pivotally connected to a connection portion 21 by inserting an insertion 412 on the first member 41 in a passage 211 defined through the connection portion 21. A second end of the bimetallic plate 3 is located above the hook portion 411. A second member 42 has two protrusions 421 extending from two opposite sides of the top end thereof and the two protrusions 421 are respectively engaged with the two holes 434 in the two lugs 433. A weight 422 is connected on one of two opposite surfaces of the second member 42 so that the second member 42 tilts an angle when pivotably connected to the connection port of the connection member 43.

Figure 5:
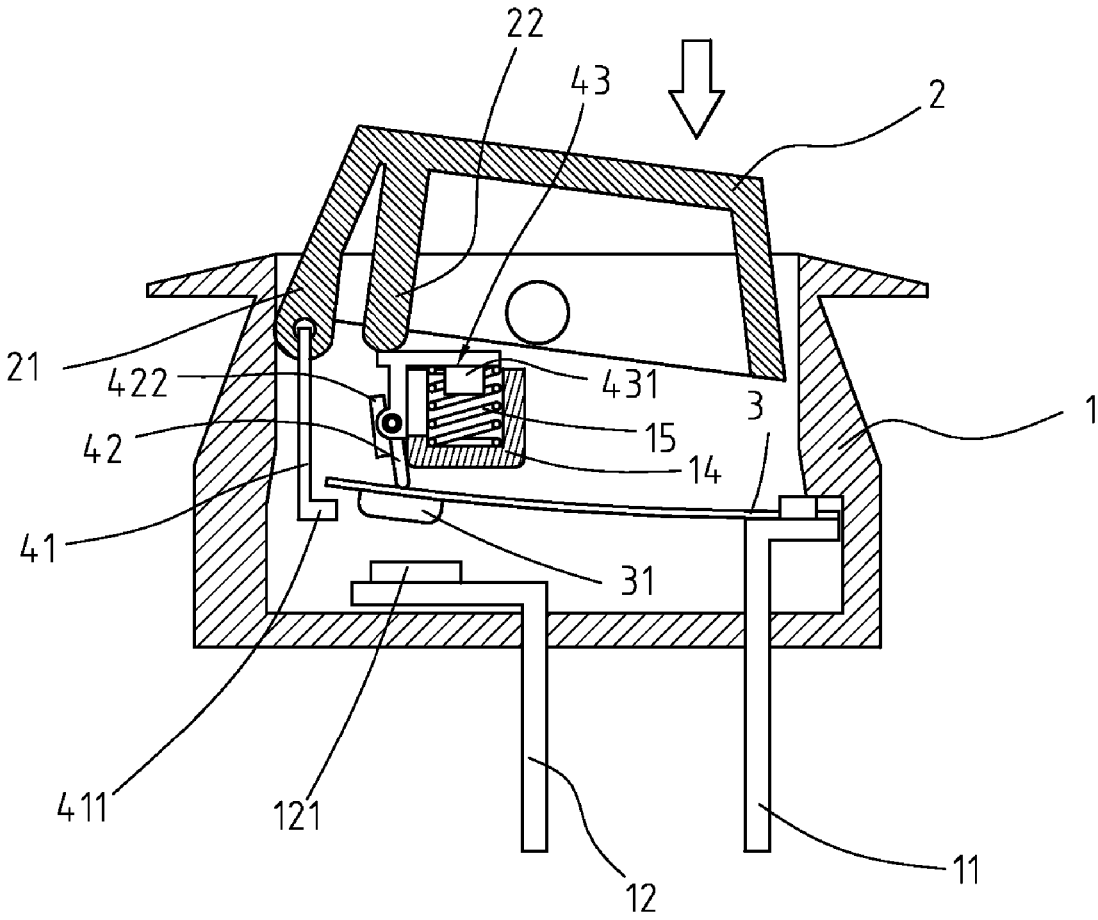
FIG. 5 shows an "OFF" status of a switch device constructed in accordance with another embodiment of the present invention.
Figure 6:
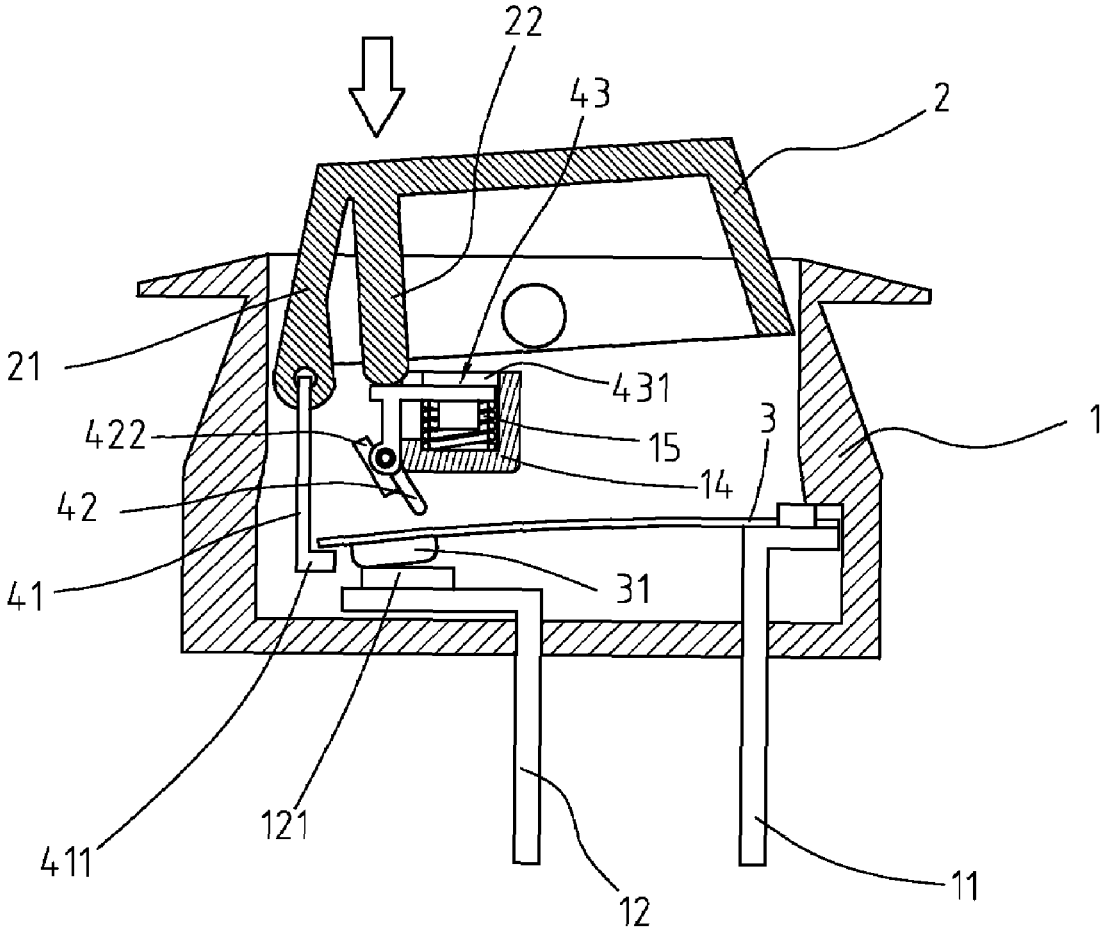
FIG. 6 shows an "ON" status of the switch device of FIG. 5.
Figure 7:
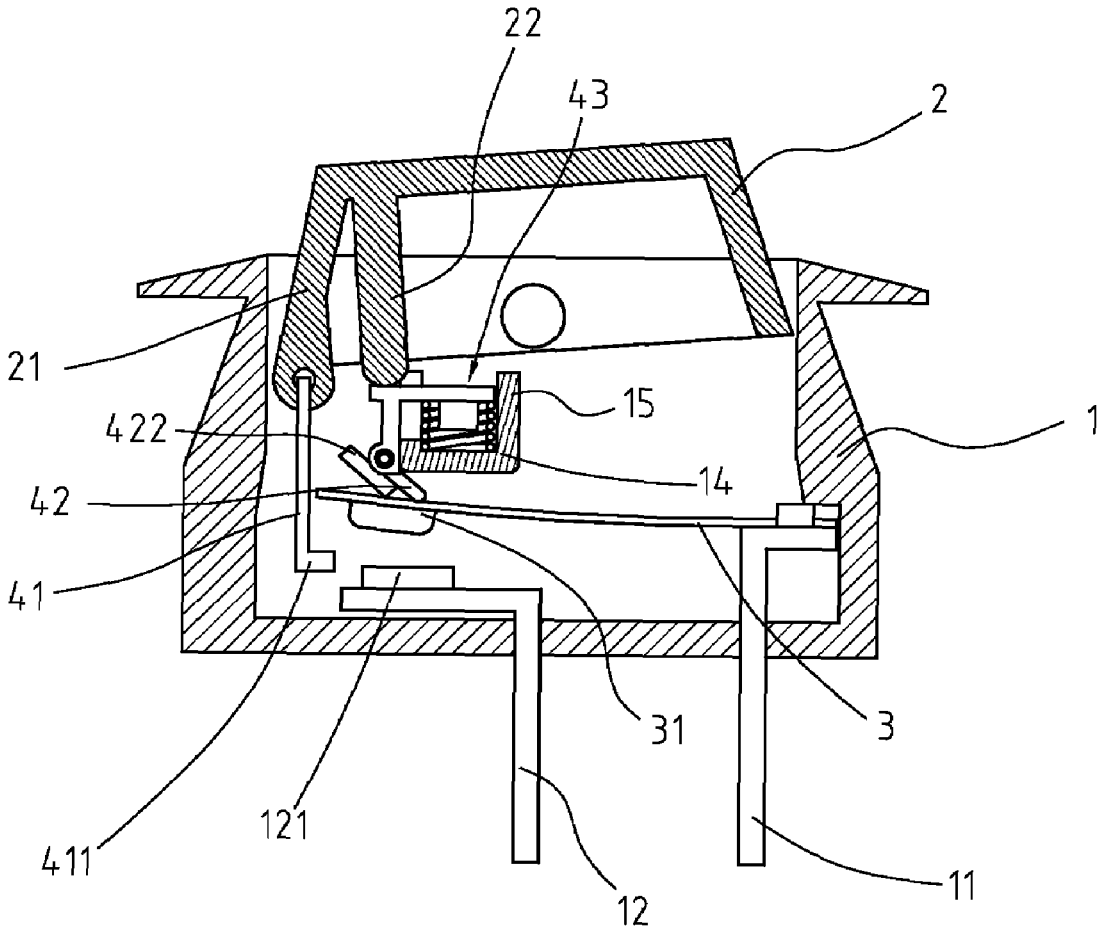
FIG. 7 shows a bimetallic plate deformed upward and a second member pivoted by the bimetallic plate when an overloading occurs.
Figure 8:
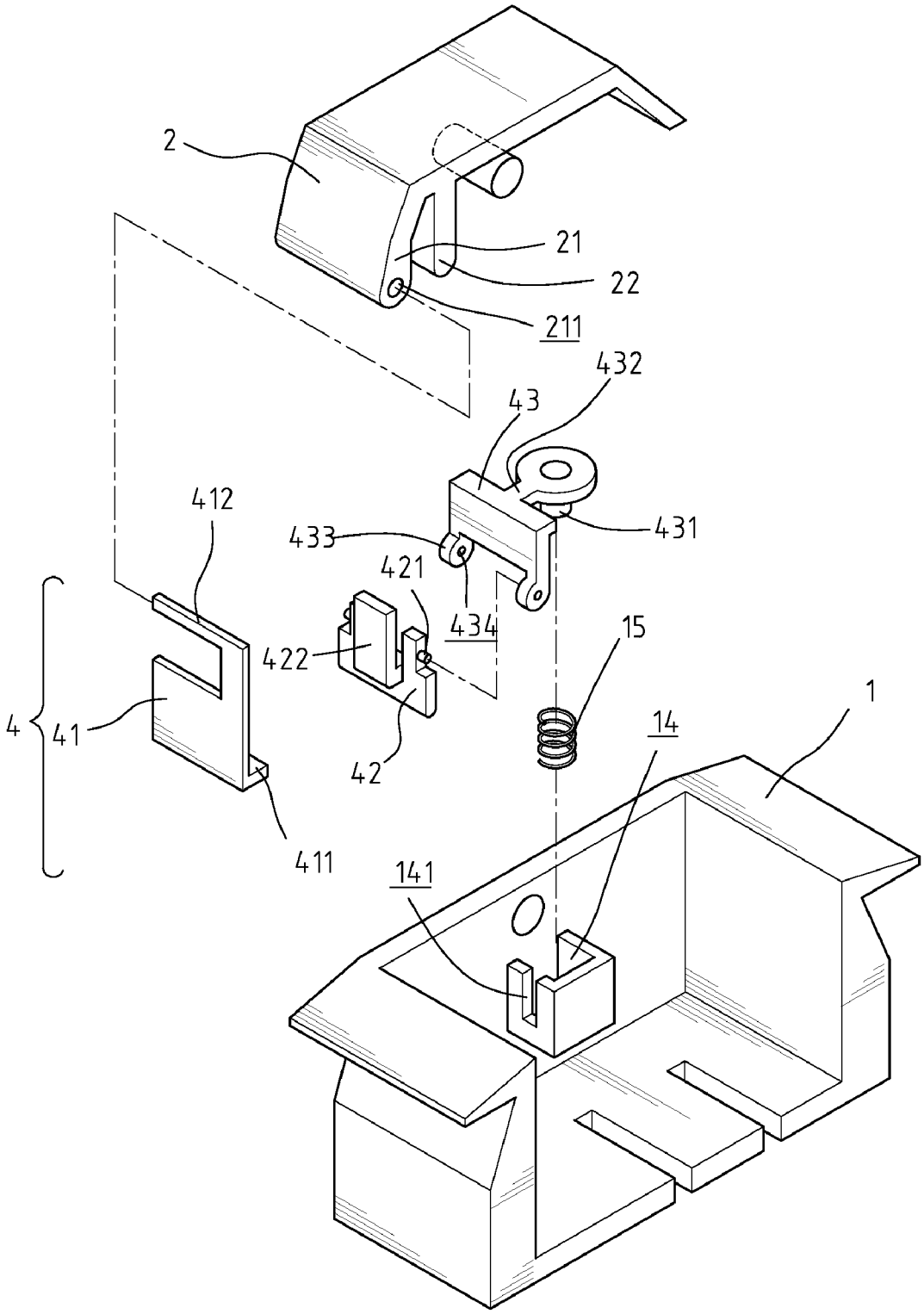
FIG. 8 is an exploded view showing a protection mechanism of the switch device shown in FIG. 5.

The switch member 2 can be pressed to set the switch device to "OFF" status as shown in FIG. 5 and the second end of the bimetallic plate 3 is lifted to separate the first and second contact points 31, 121, and the extension board 22 releases the connection member 43 which is pushed upward by the spring 15. As shown in FIG. 6, when operating the switch member 2 to set the switch device to "ON" status, the second end of the bimetallic plate 3 is pushed downward by the extension board 22, the connection member 43 and the second member 42 to put the first contact point 31 in contact with the second contact point 121. As shown in FIG. 7, when an overloading occurs, the second end of the bimetallic plate 3 is deformed upward and pivots the second member 42 counterclockwise as that was described with reference to FIG. 3.

While we have shown and described the embodiments in accordance with the present invention, it should be clear to those skilled in the art that further embodiments may be made without departing from the scope of the present invention.

What is claimed is:

1. A switch device comprising:

a case having an open top and a switch member pivotably engaged with the open top of the case, a box connected to an inside of the case and a spring received in the box;

a first terminal and a second terminal respectively extending through a bottom of the case, a bimetallic plate having a first end fixed to the first terminal and a first contact point connected to a second end of the bimetallic plate, a second contact point connected to the second terminal and located beneath the first contact point, and a protection mechanism including a first member which has a hook portion at a lower end thereof and an upper end of the first member pivotably connected to the switch member, a second end of the bimetallic plate located above the hook portion, a second member having a top end thereof pivotably connected to a connection member which is biased by the spring in the box toward the switch member and pressed by the switch member, a lower end of the second member being pushed at angle by the second end of the bimetallic plate when overload.

2. The device as claimed in claim 1, wherein the switch member has an extension board extending from a bottom thereof and pressing on the connection member.

3. The device as claimed in claim 1, wherein the box has a slot defined in one of sidewalls thereof and the connection member includes horizontal portion extending horizontally from the connection member, the horizontal portion includes a neck that is movably received in the slot and the spring biasing the horizontal portion toward the switch member.

4. The device as claimed in claim 1, wherein the connection member has a connection port and the second member is pivotably connected to the connection port.

5. The device as claimed in claim 4, wherein the connection port includes two lugs and each lug includes a hole, two protrusions extending from two opposite sides of the second member and respectively engaged with the two holes in the two lugs.

6. The device as claimed in claim 1 further comprising a weight connected on one of two opposite surfaces of the second member so that the second member tilts an angle when pivotably connected to the switch member.

* * * * *